United States Patent [19]

Matsuda et al.

[11] 4,378,683

[45] Apr. 5, 1983

[54] TRANSVERSELY STRETCHABLE STRINGER TAPE FOR SLIDE FASTENERS

[75] Inventors: Yoshio Matsuda, Nyuzen; Yoshiharu Yamaguchi, Namerikawa, both of Japan

[73] Assignee: Yoshida Kogyo K. K., Tokyo, Japan

[21] Appl. No.: 242,972

[22] Filed: Mar. 12, 1981

[30] Foreign Application Priority Data

Mar. 18, 1980 [JP] Japan ..... 55-35579[U]

[51] Int. Cl.[3] ..... D04B 23/08; D04B 23/10

[52] U.S. Cl. ..... 66/193; 66/202; 24/205.16 C

[58] Field of Search ..... 66/190, 192, 193, 195, 66/202; 24/205.1 C, 205.16 C

[56] References Cited

U.S. PATENT DOCUMENTS 4,009,597 3/1977 Wall et al. ..... 66/193
4,041,577 8/1977 Matsuda ..... 24/205.16 C
4,265,003 3/1981 Matsuda ..... 24/205.1 C

FOREIGN PATENT DOCUMENTS 1396577 6/1975 United Kingdom .

*Primary Examiner*—Ronald Feldbaum
*Attorney, Agent, or Firm*—Hill, Van Santen, Steadman, Chiara & Simpson

[57] ABSTRACT

A warp-knit stringer tape, for slide fasteners, including a pair of transversely non-stretchable longitudinal edge portions and a transversely stretchable intermediate portion extending therebetween. The stringer tape has a knit ground structure composed of chain stitches and tricot stitches. At the stretchable intermediate portion, the tricot stitches are formed of a plurality of elastic yarns such as stretch yarns, while the chain stitches are formed of a plurality of non-elastic yarns such as multi-filament yarns. At least one elastic weft yarn is laid in the knit ground structure at the stretchable intermediate portion.

21 Claims, 6 Drawing Figures

TRANSVERSELY STRETCHABLE STRINGER TAPE FOR SLIDE FASTENERS

BACKGROUND OF THE INVENTION

1. Field of the Invention

The present invention relates generally to slide fasteners, and more particularly to stringer tapes for slide fasteners suitable for use with sporting goods, bags, athletic apparel and the like which require the slide fastener to be stretchable, particularly transversely thereof.

2. Prior Art

British Pat. No. 1,396,577 discloses a pair of first and second types of transversely stretchable stringer tapes for slide fasteners. The first type of stringer tape has a transversely stretchable portion in which each of a set of only elastic weft yarns extends across two or three adjacent wales. Such a string tape tends to be unnecessarily stretched when a slider is moved along the slide fastener for opening and closing it and this stretching often causes the stringer tape to become wavy or puckered, and further, the set of only elastic weft yarns can be easily broken or otherwise damaged. With the prior stringer tape, therefore, a smooth and proper opening and closing operation of the slide fastener is difficult to achieve.

In the second type of stringer tape, a stretchable portion has a warp-knit ground structure composed of chain stitches and tricot stitches, both formed of non-elastic yarns. A set of laid-in elastic weft yarns each extend across three adjacent wales, and each of the non-elastic yarns of tricot stitches extends across an adjacent pair of wales. The non-elastic yarns are usually made of multifilament yarns that are subject to becoming shrunk and objectionably rigid when the tape is heated due to treatment such as heat-setting and dyeing. Consequently, the second type of stringer tape has only a fairly limited degree of stretchability.

SUMMARY OF THE INVENTION

According to the present invention, a warp-knit stringer tape for slide fasteners has a knit ground structure composed of chain stitches and tricot stitches. At a transversely stretchable portion of the tape, the tricot stitches are formed of a plurality of elastic yarns such as stretch yarns, and the chain stitches are formed of a plurality of non-elastic yarns such as multifilament yarns. At least one elastic weft yarn such as a spandex yarn is laid in the knit ground structure at the stretchable tape portion and extends across a plurality of wales.

It is therefore an object of the present invention to provide a transversely stretchable stringer tape with durability which tape is prevented from being stretched beyond a proper extent.

Another object of the invention is to provide a transversely stretchable stringer tape which enables a smooth and proper opening and closing operation of the slide fastener.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
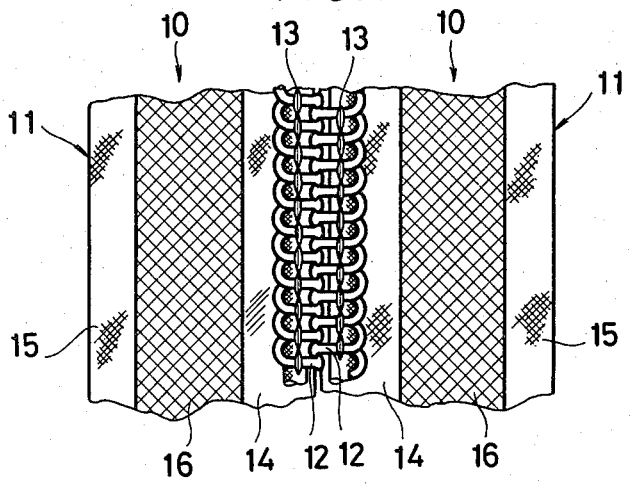
FIG. 1 is a fragmentary plan view of an interengaged pair of slide fastener stringers each including a warp-knit stringer tape according to the present invention.

FIG. 1 shows an interengaged pair of transversely stretchable slide fastener stringers 10,10 each including a warp-knit stringer tape 11 supporting on and along one longitudinal edge thereof a row of coupling elements 12 secured to the stringer tape 11 by a sewing thread 13. The stringer tape 11 has a pair of transversely non-stretchable first and second longitudinal edge portions 14,15 adjacent to the respective longitudinal tape edges, and a transversely stretchable intermediate portion 16 extending between the first and second edge portions 14,15.

Figure 2:
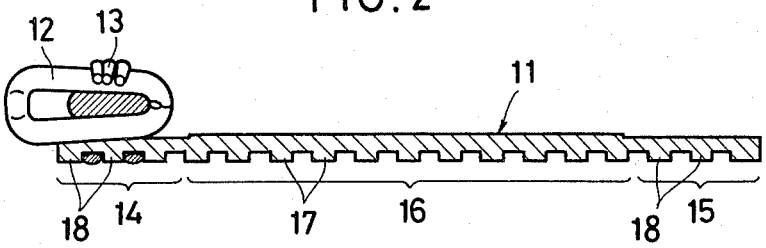
FIG. 2 is an enlarged, schematic transverse cross-sectional view of one of the stringers of FIG. 1.
Figure 3:
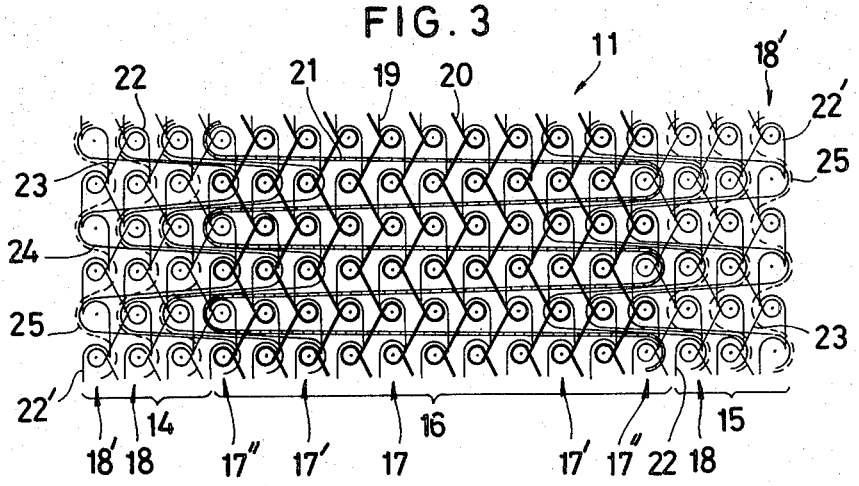
FIG. 3 is a point diagram for a warp-knit fabric structure of the tape according to a first embodiment.

The stringer tape 11 has a warp-knit ground structure composed of chain stitches and tricot stitches and having a plurality of longitudinal wales 17,18 (FIGS. 2 and 3). In FIG. 3, the chain stitches at the stretchable intermediate portion 16 are formed of a plurality of yarns 19 (hereafter called first yarns) knit in a pattern of 1-0/0-1. The first yarns 19 comprise non-elastic yarns such as multifilament yarns. The tricot stitches at the intermediate portion 16 are formed of a plurality of yarns 20 (hereafter called second yarn) knit in a pattern of 1-2/1-0. The second yarns 20 comprise elastic yarns such as stretch yarns. An elastic yarn 21 (hereafter called third yarn) is laid in the ground structure in a pattern of 0-0/11-11, extending transversely across a plurality of the wales 17. The elastic third yarn 21 comprises a spandex yarn. Alternatively the third yarn 21 may comprise a covered yarn including an elastic yarn made of polyurethane or other synthetic elastomeric filament, as a core, covered with textured yarn.

At each longitudinal edge portion 14,15, the chain stitches are formed of a plurality of fourth yarns 22 knit in a pattern of 1-0/0-1, and the tricot stitches are formed of a plurality of fifth yarns 23 knit in a pattern of 1-2/1-0. A plurality of transversely extending sixth yarns 24 are laid in the ground structure in a pattern of 0-0/4-4. Each of the sixth yarns 24 extends transversely across four adjacent ones of the wales 17,18 between an outermost wale 18' at the longitudinal tape edge and a sixth inner wale 17' (third inner wale with respect to the wale 17'' at the borderline). A plurality of longitudinally extending seventh yarns 25 are laid in the ground structure at the longitudinal tape edge in a pattern of 0-0/1-1. The fourth, fifth, sixth, and seventh yarns 22,23,24,25 comprise non-elastic yarns such as multifilament yarns.

Preferably, an outermost one 22' of the fourth yarns 22 at the outermost wale 18' has a higher degree of strength than the other fourth yarns 22 in order to make the tape edge resistant to being broken or otherwise damaged. Similarly, at the borderline wale 17'' the fourth and/or fifth yarns 22,23 with which the laid-in third yarn 21 is interlooped or otherwise connected, may have a higher degree of strength than the other fourth and fifth yarns 22,23.

The second and fifth yarns 20,23 may have a pattern of 0-2/2-0 or 0-1/3-2. The laid-in sixth yarns 24 may have a pattern of 0-0/3-3 or 0-1/4-3 or 0-1/3-2. The fifth or sixth yarns 23,24 may comprise stretch yarns, instead of multifilament yarns, in order to give the tape edges a proper degree of flexibility.

Figure 4:
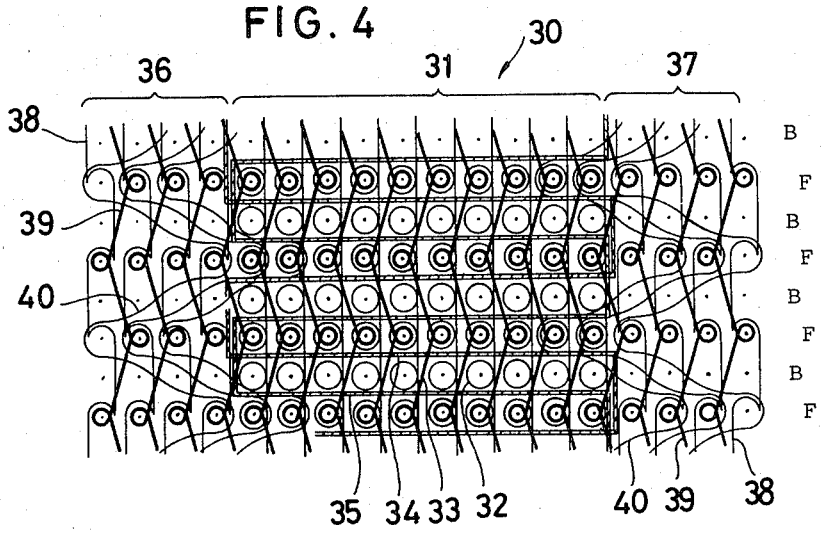
FIG. 4 is a point diagram for a warp-knit fabric structure of a modified stringer tape according to a second embodiment.

FIG. 4 illustrates a modified warp-knit stringer tape 30 which is made on a knitting machine having two guide bars and hence has a double knit structure. A stretchable intermediate portion 31 of the stringer tape 30 includes a plurality of eighth yarns 32 forming chain stitches in a pattern of 0-2/0-2/0-2/0-2, a plurality of elastic ninth yarn 33 forming tricot stitches in a pattern of 2-4/2-2/2-0/2-2, and a pair of elastic tenth yarns 34,35 laid in the knit structure. One tenth yarn 34 has a pattern of 0-0/20-20/20-20/0-0, while the other tenth yarn 35 has a pattern of 0-0/0-0/20-20/20-20. Each non-stretchable longitudinal edge portion 36,37 of the stringer tape 30 includes a plurality of eleventh yarns 38 forming chain stitches in a pattern of 2-0/0-0/0-2/2-2, a plurality of twelfth yarns 39 forming tricot stitches in a pattern of 2-4/2-2/2-0/2-2, and a plurality of laid in thirteenth yarns 40 having a pattern of 0-0/4-4/8-8/4-4. The eighth, ninth, tenth, eleventh, twelfth and thirteenth yarns 32,33,34(35),38,39,40 correspond to the first, second, third, fourth, fifth, and sixth yarns 19,20,21,22,23,24, respectively, in the embodiment of FIG. 3 and each comprise the same kind of yarns as the corresponding yarns. In FIG. 4, F and B represent "Front Guide Bar" and "Back Guide Bar", respectively.

Figure 5:
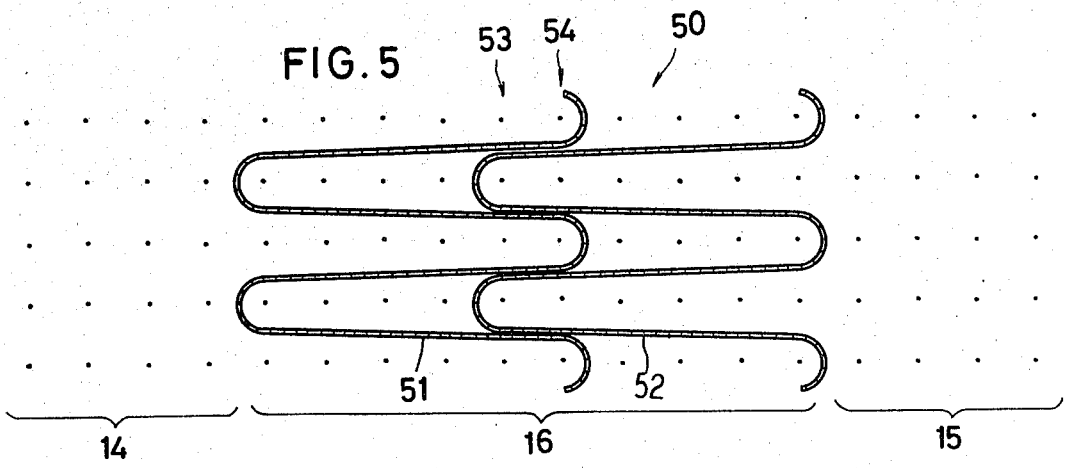
FIG. 5 is a point diagram for the pattern of a pair of elastic weft yarns laid in according to a third embodiment.
Figure 6:
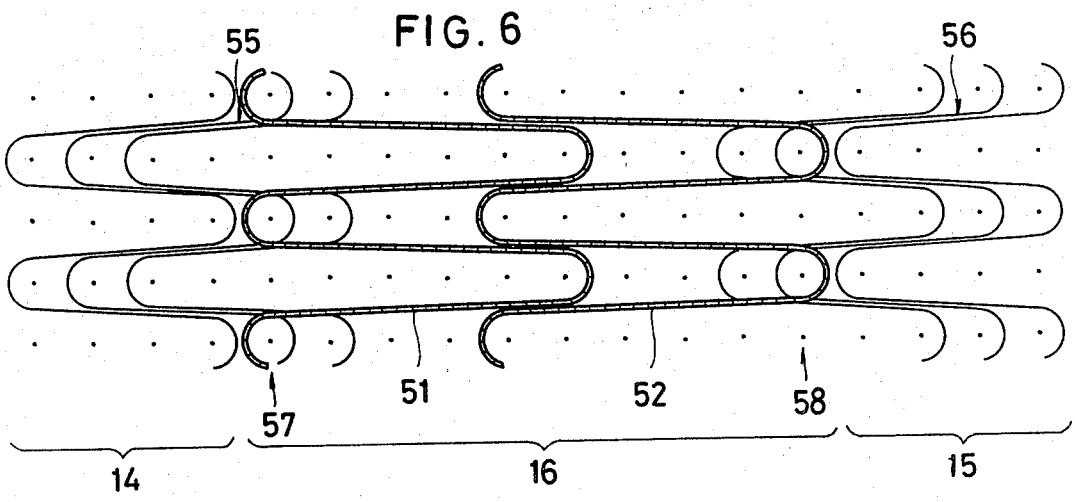
FIG. 6 is a point diagram similar to FIG. 5, showing a fourth embodiment.

FIG. 5 illustrates a third embodiment similar to the embodiment of FIG. 3, and the only difference therefrom is that a stringer tape 50 includes a pair of elastic fourteenth yarns 51,52 instead of the third yarn 21 (FIG. 3), the fourteenth yarns 51,52 being laid in a pattern of 0-0/6-6. The two fourteenth yarns 51,52 meet together alternately longitudinally of the tape 50 at an adjacent pair of central wales 53,54. Because each of the laid-in fourteenth yarns 51,52 extends transversely across only a less number of wales, the stringer tape 50 can be made at an increased rate of knitting speed. To effect a strong connection between the stretchable and non-stretchable tape portions, the stringer tape 50 further includes a plurality of laid-in fifteenth yarns 55,56 joined or connected with the fourteenth yarns 51,52 at the borderline wales 57,58, respectively, as shown in FIG. 6.

In any of the embodiments described above, the tricot stitches, if stretch yarns are used therefor, not only give the stringer tape an increased degree of stretchability, but also prevent the elastic weft yarn or yarns from being excessively stretched. This is so because stretch yarns are resistant to becoming rigid due to the treatment, such as heat-setting and dyeing, of the tape. The stretch yarns having been fully stretched have a good extensive strength.

The stretchable portion of the stringer tape constructed in accordance with the present invention comprises a warp-knit ground structure including a plurality of elastic yarns each extending across at least an adjacent pair of wales, and at least one elastic weft yarn laid in the ground structure, each weft yarn extending across a plurality of wales. Thus elastic yarns are used not only for the knit ground structure but also for the laid-in weft yarn or yarns. With such an arrangement it is possible to give the stringer tape an increased degree of stretchability without using special large-diameter elastic yarns for the weft yarns. An appropriate combination of kinds of yarns may be chosen for these two elastic yarns to provide a stringer tape having a proper degree of stretchability that depends on the use.

Another advantageous feature of this stringer tape is that each of the elastic yarns of the knit ground structure extends across only a few adjacent wales; that is, the distance between adjacent stitch loops between which the individual elastic yarns extend is relatively short. The extent to which such and each inter-loop section of the elastic yarn may be stretched is relatively small. Accordingly, the elastic yarns of the knit ground structure, as a whole, serve to prevent the elastic weft yarn or yarns and thus the stringer tape from being stretched beyond a proper extent.

Moreover, the elastic yarns of the knit ground structure are knit so as to form stitch loops in every course and wale uniformly throughout the stretchable intermediate tape portion. Such an intermediate tape portion has a well-balanced fabric structure with a sufficient degree of strength, making the stringer tape at the stretchable portion capable of being sewn without difficulty.

The resultant stringer tape is transversely stretchable within a predetermined limit only when a transverse pull is exerted upon the tape. In other words, the stringer tape would not be stretched simply by pulling a slider longitudinally along the slide fastener for opening and closing it. With this arrangement a smooth movement of the slider for opening and closing the slide fastener is achieved, and hence durability of the slide fastener is guaranteed.

Although various minor modifications may be suggested by those versed in the art, it should be understood that we wish to embody within the scope of the patent warranted hereon, all such embodiments as resonably and properly come within the scope of our contribution to the art.

What is claimed is:

1. A transversely stretchable stringer tape for a slide fastener having a pair of rows of coupling elements, comprising:

(a) an elongate warp-knit web having a plurality of longitudinal wales disposed between a pair of longitudinal edges, said web including a pair of marginal portions extending along said pair of longitudinal edges, respectively, and an intermediate portion extending between said marginal portions, at least one of said marginal portions being non-stretchable for supporting therealong one coupling element row of the slide fastener;

(b) said intermediate portion being transversely stretchable and including a plurality of yarns (hereafter called second yarns) forming a knit ground structure containing stitch loops, and at least one elastic yarn (hereafter called third yarn) laid in said knit ground structure and extending transversely across a plurality of adjacent ones of said wales, said second yarns being elastic and each extending across at least an adjacent pair of said wales, the number of the wales across which each said second yarn extends being smaller than the number of the wales across which said third yarn extends.

2. A stringer tape according to claim 1, each said second yarn extending across less than five adjacent ones of said wales.

3. A stringer tape according to claim 1, said intermediate portion further including a plurality of yarns (hereafter called first yarns) knit in said ground structure.

4. A stringer tape according to claim 3, said knit ground structure comprising chain stitches formed of said first yarns and tricot yarns formed of said second yarns.

5. A stringer tape according to claim 3, said first yarns having a pattern of 1-0/0-1.

6. A stringer tape according to claim 1, said second yarns having a pattern of 1-2/1-0.

7. A stringer tape according to claim 1, said laid-in third yarn having a pattern of 0-0/11-11.

8. A stringer tape according to claim 1, said laid-in third yarn having a pattern of 0-0/6-6.

9. A stringer tape according to claim 1, said non-stretchable portion of said web including a plurality of fourth yarns knit in a pattern of 1-0/0-1, and a plurality of fifth yarns knit in a pattern of 1-2/1-0.

10. A stringer tape according to claim 9, said non-stretchable portion of said web further including a plurality of transversely extending sixth yarns having a pattern of 0-0/4-4, and a plurality of longitudinally extending seventh yarns having a pattern of 0-0/1-1.

11. A stringer tape according to claim 4, said first yarns having a pattern of 0-2/0-2/0-2/0-2, and said second yarns having a pattern of 2-4/2-2/2-0/2-2.

12. A stringer tape according to claim 11, said laid-in third yarn having a pattern of 0-0/20-20/20-20/0-0.

13. A stringer tape according to claim 11, said laid-in third yarn having a pattern of 0-0/0-0/20-20/20-20.

14. A stringer tape according to claim 11, said non-stretchable portion of said web including a plurality of fourth yarns knit in a pattern of 0-2/0-0/0-2/2-2, and a plurality of fifth yarns knit in a pattern of 2-4/2-2/2-0/2-2.

15. A stringer tape according to claim 14, said non-stretchable portion of said web further including a plurality of transversely extending sixth yarns having a pattern of 0-0/4-4/8-8/4-4.

16. A stringer tape according to claim 1, said elastic second yarns comprising stretch yarns.

17. A stringer tape according to claim 1, said elastic third yarn comprising a spandex yarn.

18. A stringer tape according to claim 3, said first yarns comprising multifilament yarns.

19. A stringer tape according to claim 9, said fourth and fifth yarns comprising multifilament yarns.

20. A stringer tape according to claim 9, said fourth yarns comprising multifilament yarns and said fifth yarns comprising stretch yarns.

21. A stringer tape according to claim 11, said sixth and seventh yarns comprising multifilament yarns.

* * * * *